US007909677B2

(12) United States Patent
Yang et al.

(10) Patent No.: US 7,909,677 B2
(45) Date of Patent: Mar. 22, 2011

(54) METHOD OF TRANSFERRING A WAFER

(75) Inventors: Kuo-Wei Yang, Hsin-Chu (TW); Hui-Shen Shih, Chang-Hua Hsien (TW); Chih-Jen Mao, Tainan Hsien (TW); Cho-Long Lin, Taoyuan County (TW)

(73) Assignee: United Microelectronics Corp., Science-Based Industrial Park, Hsin-Chu (TW)

( * ) Notice: Subject to any disclaimer, the term of this patent is extended or adjusted under 35 U.S.C. 154(b) by 537 days.

(21) Appl. No.: 11/748,477

(22) Filed: May 14, 2007

(65) Prior Publication Data

US 2008/0287044 A1 Nov. 20, 2008

(51) Int. Cl.
*B24B 1/00* (2006.01)

(52) U.S. Cl. ..... 451/41; 451/36; 451/339

(58) Field of Classification Search ..... 451/36, 451/41, 63, 339; 438/690–693
See application file for complete search history.

(56) References Cited

U.S. PATENT DOCUMENTS

| | | | | |
|---|---|---|---|---|
| 6,294,470 | B1 | 9/2001 | Economikos et al. | |
| 6,537,143 | B1 * | 3/2003 | Yang et al. | 451/388 |
| 6,569,769 | B1 | 5/2003 | Economikos et al. | |
| 7,044,832 | B2 * | 5/2006 | Yilmaz et al. | 451/5 |
| 2001/0005665 | A1 * | 6/2001 | Hempel et al. | 451/41 |
| 2004/0127142 | A1 * | 7/2004 | Olgado | 451/5 |
| 2005/0274393 | A1 | 12/2005 | Perng et al. | |
| 2007/0123047 | A1 * | 5/2007 | Shirasu et al. | 438/692 |
| 2008/0268753 | A1 * | 10/2008 | Ishikawa et al. | 451/36 |

* cited by examiner

*Primary Examiner* — Timothy V Eley
(74) *Attorney, Agent, or Firm* — Winston Hsu; Scott Margo

(57) ABSTRACT

A method of transferring a wafer is disclosed. The method comprises providing a pedestal and at least one spray orifice extending through the pedestal; disposing a wafer above the pedestal using a first robot, wherein the wafer has a first surface and a second surface, the first surface faces the pedestal, a fluid is sprayed onto the first surface simultaneously to avoid a contact of the first surface with the pedestal, and the fluid contains a charge-forming chemical substance dissolved therein; and taking the wafer using a robot for delivery. Due to the charge-forming chemical substance dissolved in the fluid, the waterfall effect to cause discharge damage on the wafer is avoided in the spraying of the fluid.

6 Claims, 5 Drawing Sheets

METHOD OF TRANSFERRING A WAFER

BACKGROUND OF THE INVENTION

1. Field of the Invention

The present invention generally relates to a method of transferring a wafer, and particularly to a method of transferring a wafer to or from a load cup.

2. Description of the Prior Art

Chemical mechanical polishing generally removes material from a semiconductor wafer through a chemical or a combined chemical and mechanical process. In a typical chemical mechanical polishing system, a wafer is held by a polishing head in a feature side down orientation above a polishing surface. The polishing head is lowered to place the substrate in contact with the polishing surface. The wafer and polishing surface are removed relative to one another in a predefined polishing motion. A polishing fluid is typically provided on the polishing surface to drive the chemical portion of the polishing activity. Some polishing fluids may include abrasives to mechanically assist in the removal of material from the wafer.

A wafer transfer mechanism, commonly referred to as a load cup, is utilized to transfer the wafer into the polishing head in a feature side down orientation. As the feature side of the wafer faces the load cup while the wafer is retained therein, care must be taken to avoid damage to the feature side of the wafer through contact with the load cup. For example, the feature side of the wafer may be scratched by surfaces of the load cup that supports the wafer during the transfer process with the polishing head. Additionally, particulates generated during the wafer transfer or generated by contact of the wafer to the load cup may be carried on the wafer's surface to the polishing surface. During polishing, these particulates may cause substrate scratching, which results in non-uniform polishing and device defects. Therefore, it would be advantageous to minimize contact of substrate to load cup.

FIG. 1 is a schematic view of a conventional chemical mechanical polisher. The chemical mechanical polisher 10 includes a base 12, a head clean load/unload (HCLU) station 14, and a rotary bearing 16. The base 12 includes a polishing pad 18 disposed on the base 12. The HCLU station 14 includes a load cup 20 for loading/unloading wafers on/from the polishing head. The rotary bearing 16 includes a plurality of polishing heads 22 to hold and rotate wafers on the polishing pads 18. The load cup 20 includes a pedestal support column 26 to support a pedestal 24. Wafers can be transferred from the pedestal to the polishing head 22 or from the polishing head 22 to the pedestal.

Referring to FIG. 2, a pedestal film 27 may be disposed on the upper surface of the pedestal 24 for contacting the feature side (i.e. the side having IC devices) of the wafer. The spray orifice 28 extends through the pedestal 24 and the pedestal film 27. The bottom surface of the polishing head 22 and the top surface of the pedestal film 27 are washed at the load cup 20 by the ejection of washing fluid through the spray orifice 28. Each wafer is loaded by a transfer robot (not shown) from a loadlock chamber (not shown), onto the load cup 20.

The transfer robot includes a robot blade that is inserted into the loadlock chamber and lifts each wafer individually from the loadlock chamber and places the wafer above the pedestal 24 of the load cup 20. For avoiding the contact of the wafer with the load cup 20, a fluid (such as deionized water) is generally sprayed from a spray orifice (which may be same as or different from the spray orifice 28) extending through the pedestal and the sprayed fluid is between the wafer and the pedestal 24 to float the wafer, such that the contact of the wafer with the load cup is minimized. Thereafter, the polishing head 22 on the rotary bearing 16 holds the wafer away from the pedestal 24 for a subsequent polishing process.

The polished wafer is unloaded from the polishing head 22 and placed into the load cup 20. Similarly, for avoiding the contact of the wafer with the load cup 20, a fluid is sprayed and between the wafer and the pedestal 24 to float the wafer, such that the contact of the wafer with the load cup is minimized. After the load cup 20 is fully filled with the fluid, the surface tension of the fluid may help pulling down the wafer from the polishing head to place the wafer into the load cup. After the wafer is placed into the load cup 20, the wafer may be taken from the load cup by a transfer robot to the next process system.

A conventional technique, such as U.S. patent application publication No. 2005/0274393, which is incorporated herein by reference, discloses a process for cleaning a semiconductor wafer, in which, a cleaning fluid dissolving an ion-forming gas is used to wash polished wafers to reduce or eliminate charge-up damage caused by friction which is generated between the wafer and rinsing water or other fluid as the wafer is rotated during the cleaning process. U.S. Pat. Nos. 6,569,769 and 6,294,470, which are incorporated herein by reference, disclose a chemical mechanical polishing process, in which, an aqueous liquid medium containing a polyelectrolyte is used with polishing slurry to polish wafers, to effectively planarize an oxide layer, even the starting oxide layer has significant topographical variation.

However, the inventors of the present invention found, during a chemical mechanical polishing process, the disappointing yield is partly attributed to a damage caused during the wafer transfer, not the polishing or cleaning process. Therefore, there is still a need for the improvement of wafer transfer.

SUMMARY OF THE INVENTION

Accordingly, an object of the present invention is to provide a method of transferring a wafer to avoid a local discharge damage of the wafer due to the waterfall effect occurred to the water spray used for assisting the wafer transfer.

The method of transferring a wafer according to the present invention comprises steps as follows. First, a pedestal is provided. There is at least one spray orifice extending through the pedestal. A wafer is disposed above the pedestal using a first robot. The wafer has a first surface and a second surface. The first surface faces the pedestal. A fluid is sprayed from the spray orifice onto the first surface simultaneously with the disposition of the wafer above the pedestal to avoid a contact of the first surface with the pedestal. The fluid contains a charge-forming chemical substance dissolved therein. Thereafter, the wafer is taken using a second robot for delivery.

According to another embodiment of the present invention, the method of transferring a wafer in a chemical mechanical polisher is provided. The chemical mechanical polisher comprises a head clean load/unload station and at least one polishing head. The head clean load/unload station comprises a load cup. The load cup comprises a pedestal and at least one spray orifice extending through the pedestal. The method comprises steps as follows. A wafer is disposed above the pedestal using a robot. The wafer has a first surface and a second surface. The first surface faces the pedestal. A fluid is sprayed from the spray orifice onto the first surface simultaneously with the disposition of the wafer above the pedestal to avoid a contact of the first surface with the pedestal. The fluid contains a charge-forming chemical substance dissolved therein. Thereafter, the wafer is taken by securing the second surface on the polishing head through a vacuum.

According to still another embodiment of the present invention, the method of transferring a wafer in a chemical mechanical polisher is provided. The chemical mechanical polisher comprises a head clean load/unload station and at least one polishing head. The head clean load/unload station comprises a load cup. The load cup comprises a pedestal and at least one spray orifice extending through the pedestal. The method comprises steps as follows. A wafer secured to the polishing head is disposed above the pedestal. The wafer has a first surface and a second surface. The first surface faces the pedestal. A fluid is sprayed from the spray orifice onto the first surface simultaneously with the disposition of the wafer above the pedestal to form a fluid layer in the load cup, such that the wafer floats to avoid a contact of the first surface with the pedestal. The fluid contains a charge-forming chemical substance dissolved therein. Thereafter, the wafer is taken using a robot for delivery.

These and other objectives of the present invention will no doubt become obvious to those of ordinary skill in the art after reading the following detailed description of the preferred embodiment that is illustrated in the various figures and drawings.

DETAILED DESCRIPTION

After the research and study for the disappointing yield of the conventional chemical mechanical polishing process, the inventors understand that when a wafer is transferred via a HCLU station, a fluid (such as deionized water) is sprayed out from an spray orifice in a load cup to assist the wafer transfer into or away from the chemical mechanical polisher, and such sprayed deionized water forms a waterfall due to a water pressure, leading to the waterfall effect which causes electrostatic discharge. In other words, according to the theory of Lenard effect, charges tend to separate and accumulate in such waterfall. When these charges contact a wafer, a local discharge may occur to the wafer, leading damage to the structure on the wafer.

Figure 1:
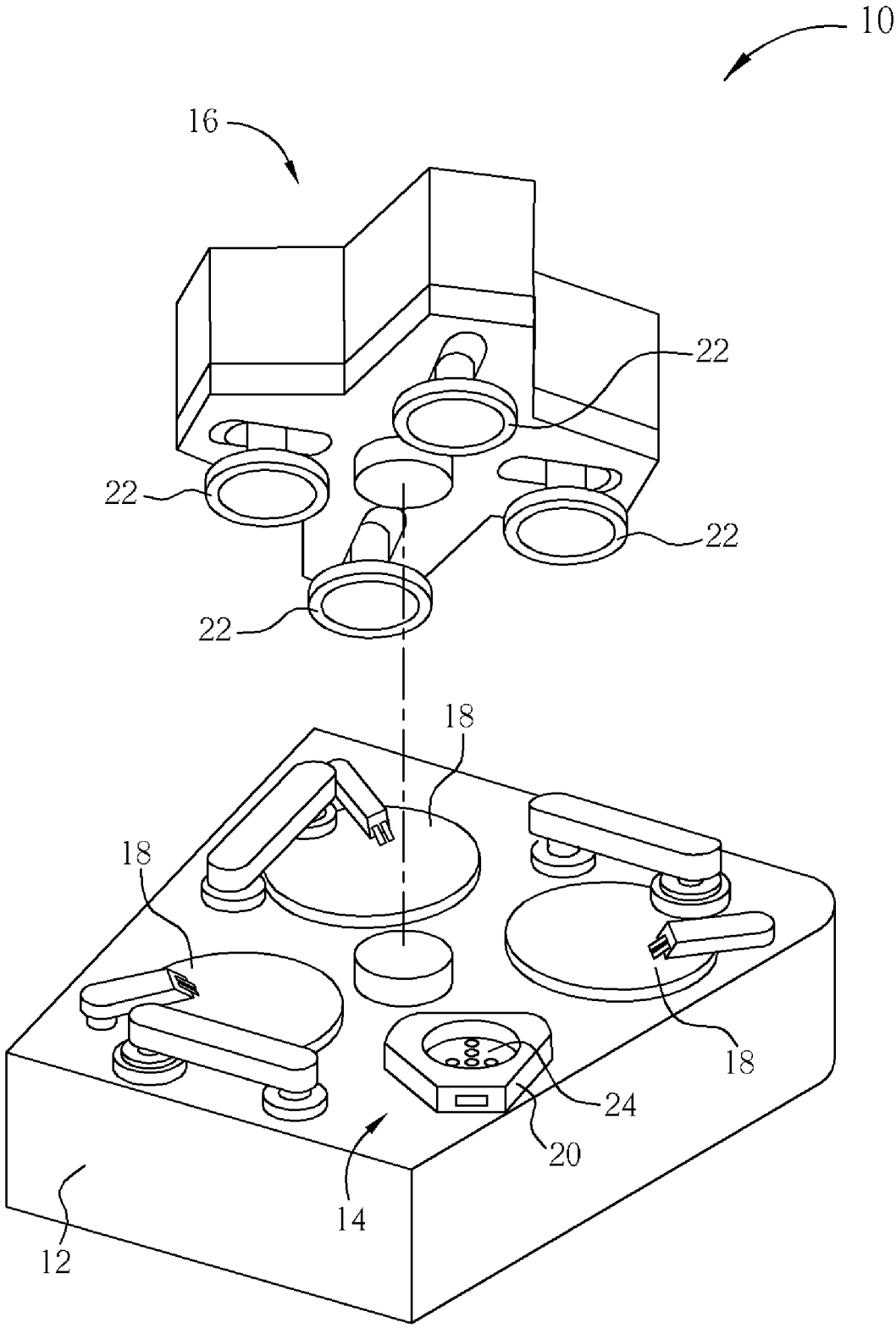
Fig. 1 Prior art
FIG. 1 is a perspective view of a conventional chemical mechanical polisher.
Figure 2:
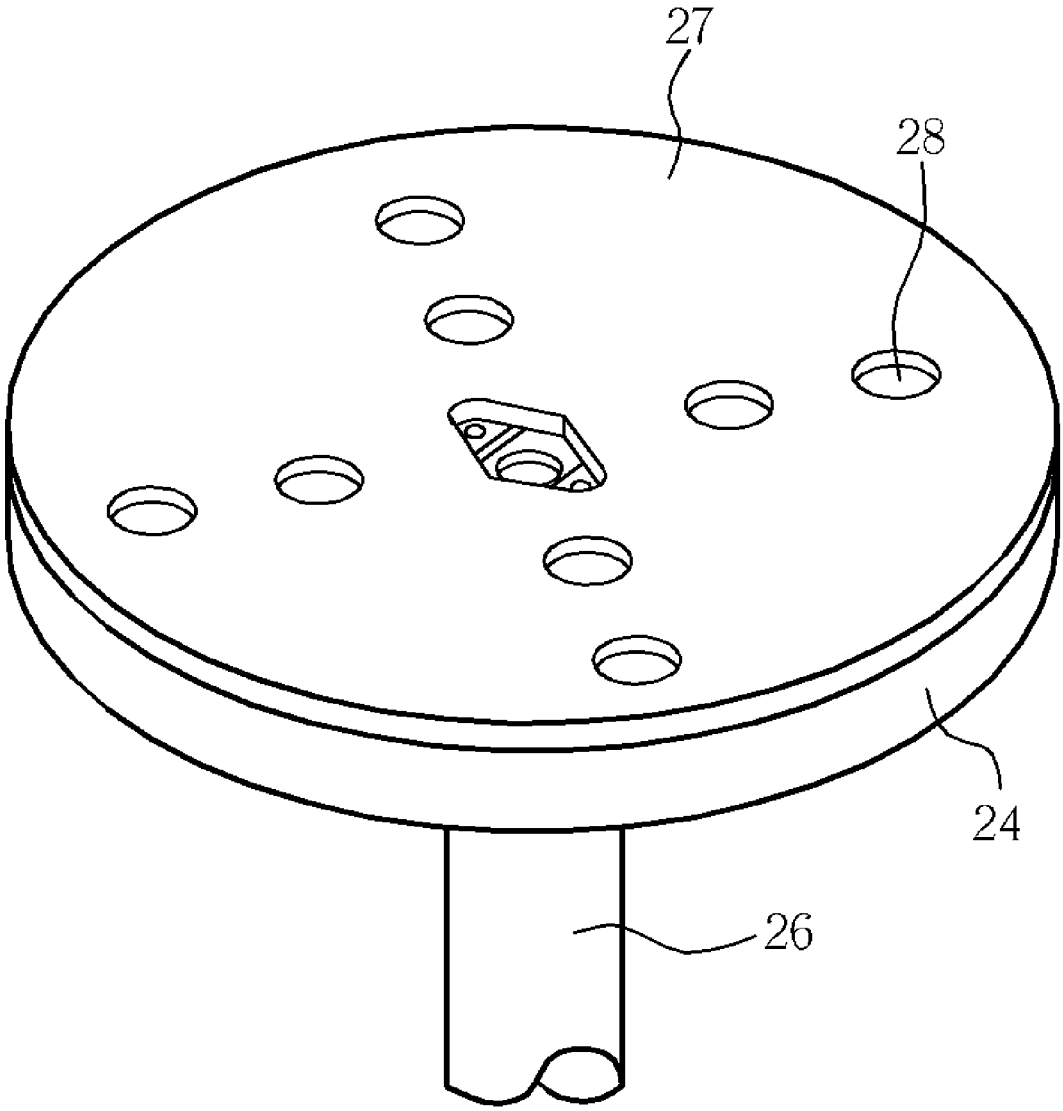
Fig. 2 Prior art
FIG. 2 is a perspective view of a conventional pedestal assembly of a chemical mechanical polisher.
Figure 3:
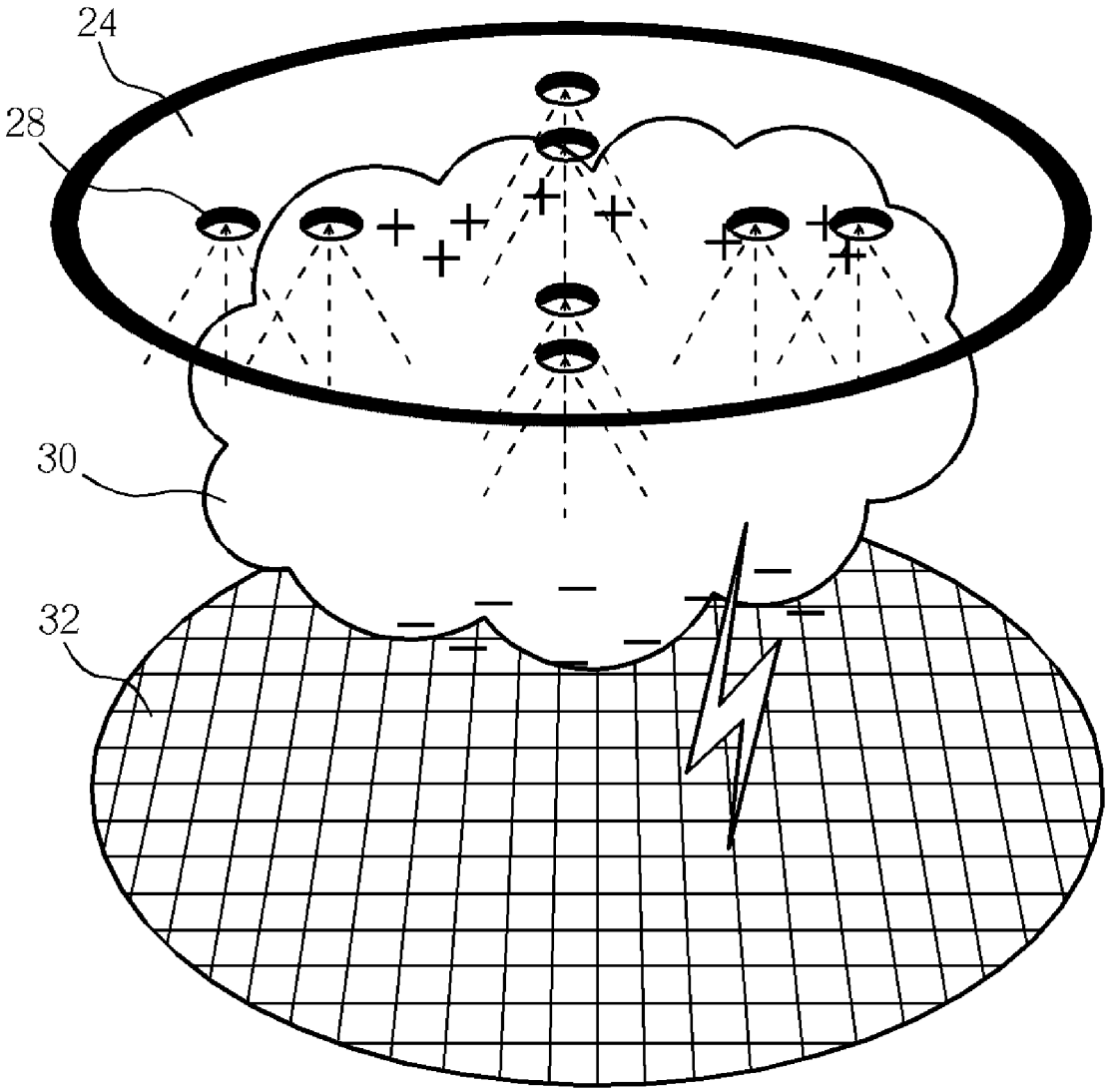
Fig. 3 Prior art
FIG. 3 is a schematic view showing wafer discharge due to the waterfall effect.
Figure 4:
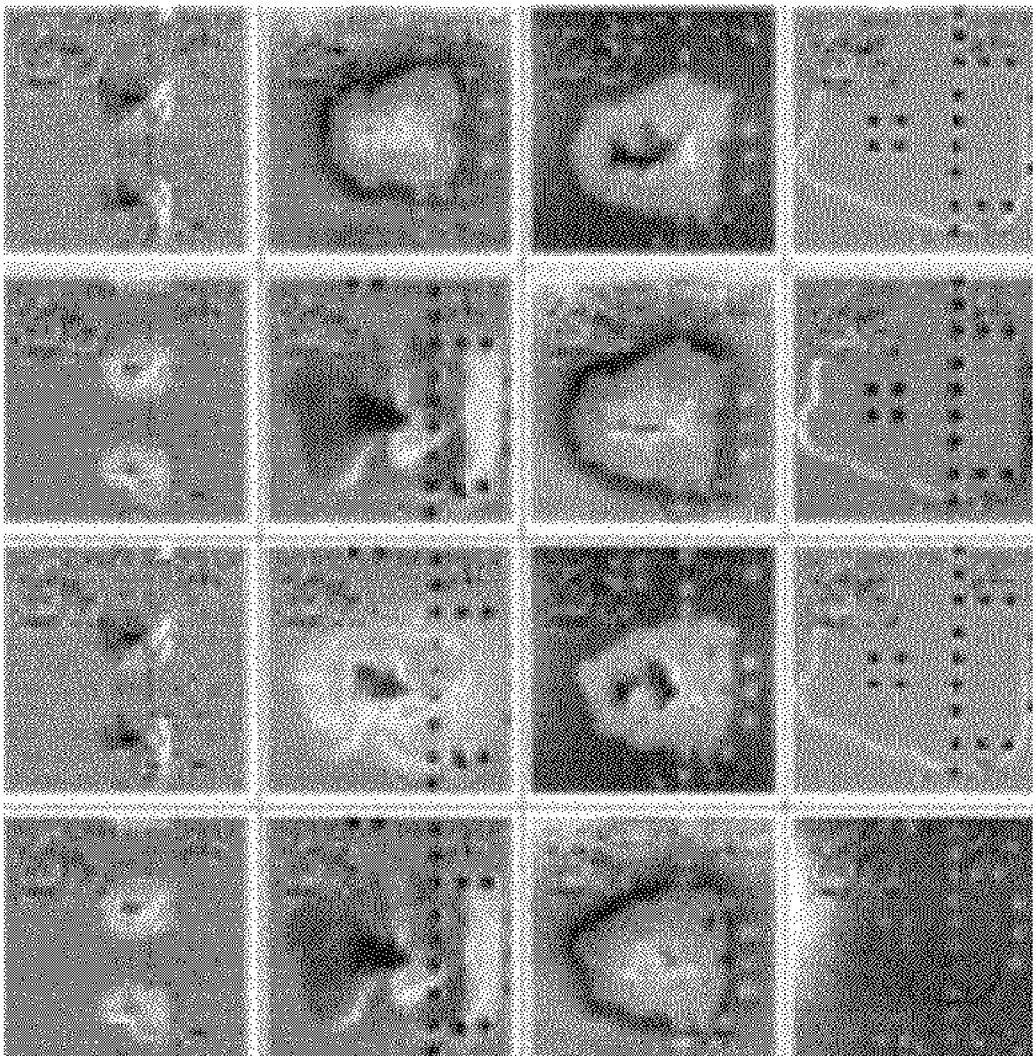
Fig. 4 Prior art
FIG. 4 shows testing results of local damages of a wafer caused by discharge due to the waterfall effect.

The Lenard effect is referred to the separation of electric charges accompanying the aerodynamic breakup of water drops. Such phenomenon frequently occurs in clouds of a thunderstorm, waves, or waterfalls. The water drops of the upper part usually carry positive charges, and the water drops of the lower part usually carry negative charges. For example, FIG. 3 shows a schematic view of wafer discharge due to the waterfall effect. The position of the pedestal and the wafer is illustrated in a way of up side down for convenient understanding. The waterfall 30 sprayed from the spray orifices 28 on the pedestal 24 carries positive charges in the water drops near the spray orifices 28 and negative charges in the water drops far from the spray orifices 28, in accordance with the Lenard effect. When the feature side of the wafer 32 approaches the waterfall, discharge is induced. Therefore, in the image of testing results, some donut puddle areas are often obtained, as shown in FIG. 4. Such areas indicate local damages caused by discharge from the waterfall and such areas leads to a poor yield. Therefore, the inventors provide the present invention to solve such problem.

Figure 5:
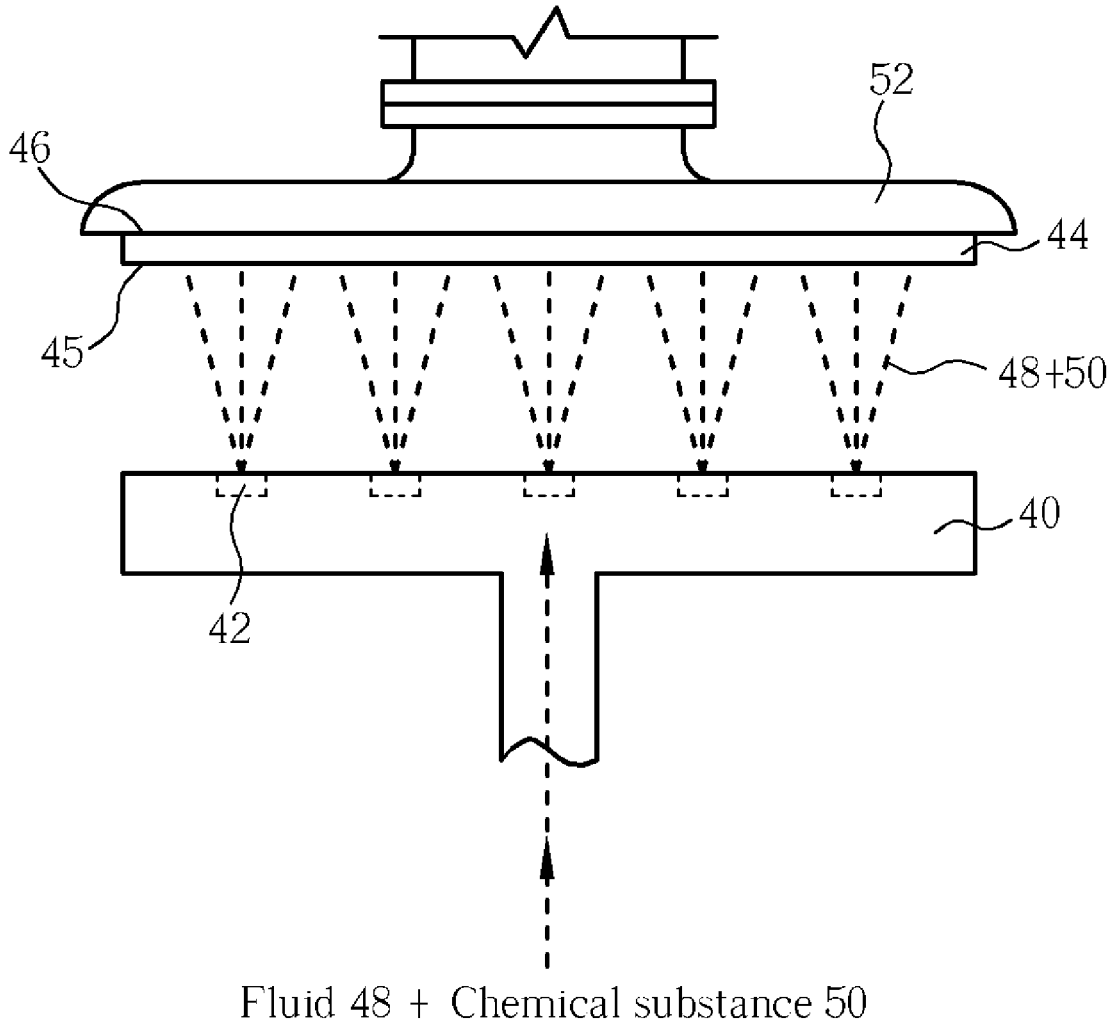
FIG. 5 is a schematic side view showing a wafer secured to a polishing head and the fluid spray in an embodiment of the method of transferring a wafer in a chemical mechanical polisher according to the present invention.

The inventors found the reason for the wafer defect occurring in the wafer transfer before or after the chemical mechanical polishing process and developed a method of transferring a wafer to prevent the wafer from damage due to local electric discharge. The wafer herein especially means a semiconductor wafer or substrate having some feature patterns of devices. Referring to FIG. 5, the method of transferring a wafer in a chemical mechanical polisher according to the present invention is described. The chemical mechanical polisher comprises a head clean load/unload station and at least one polishing head 52. The head clean load/unload station comprises a load cup (not shown). The load cup comprises a pedestal 40 and at least one spray orifice 42 extending through the pedestal 40. The method according to the present invention comprises steps as follows. First, a wafer 44 is disposed above the pedestal 40 using a robot (not shown). Specifically, each wafer is loaded by a transfer robot (not shown) from a loadlock chamber (not shown) onto the pedestal 40 in the load cup. The transfer robot includes a robot blade that is inserted into the loadlock chamber and lifts each wafer individually from the loadlock chamber and places the wafer above the pedestal 40. The wafer 44 has a first surface 45 and a second surface 46. The wafer 44 is placed in a way that the first surface 45 faces the pedestal 40. The first surface is the side having device features thereon. A fluid 48 is sprayed from the spray orifice 42 onto the first surface 45 simultaneously with the disposition of the wafer 44 above the pedestal 40 to avoid a contact of the first surface 45 with the pedestal 40. The present invention is characterized that a charge-forming chemical substance 50 is dissolved in the fluid 48. When the charge-forming chemical substance 50 is dissolved in the fluid, it can generate charge. After the wafer is loaded into the load cup, the wafer 44 is taken out by securing the second surface 46 (which is usually a back side of a wafer without feature patterns of devices) onto the polishing head 52 through a vacuum and placed to face a polishing pad with the first surface for polishing. Thus, when the fluid 48 sprayed from the spray orifice 42 lifts the wafer 44, it is advantageous for the polishing head 52 to secure the wafer 44 and friction between the wafer 44 and the pedestal 40 can be avoided.

The difference between the methods of transferring a wafer in a chemical mechanical polisher according to the present invention and the conventional technique is that, in the method according to the present invention, the fluid sprayed from the spray orifice contains a charge-forming chemical substance dissolved therein, for example, a gas or electrolyte which may dissociate in the fluid to produce electric charges. Accordingly, the fluid has a small amount of charges to effectively inhibit or reduce the waterfall effect and thus to avoid or decrease the discharge. The fluid is not limited to a gas or a liquid. The fluid may be for example water. The concentration of the chemical substance in the fluid is not particularly limited, as long as the chemical substance substantially exists in the fluid and it will have the effect to reduce the waterfall effect. When a solid chemical substance is used to dissolve in the fluid, the concentration is preferably not more than the solubility of the chemical substance in the fluid for preventing the chemical substance from precipitation to affect the properties of the devices. Besides, a high concentration causes a high cost and it is economically disadvantageous. The aforesaid gas may include, for example, $O_2$, $O_3$, $N_2$, $CO_2$, $NH_3$, or air, which has a proper solubility in the water for use in the present invention and can be easily removed after use such that it will not become a pollutant in subsequent processes. The solubility of $O_2$, $O_3$, $N_2$, and $CO_2$ in water is $2.29\times10^{-5}$ ($O_2$), $1.89\times10^{-6}$ ($O_3$), $1.18\times10^{-5}$ ($N_2$), and $6.15\times10^{-4}$ ($CO_2$), respectively, by molar fraction. The chemical substance may be an electrolyte, such as a weak acid, a weak base, or a neutral electrolyte, such that the pH of the resulting fluid may be preferably between 5 and 9 and not harmful to the wafer.

After the chemical mechanical polishing process, the polished wafer 44 secured on the polishing head 52 may be placed above the pedestal 40 for transferring to other apparatus. The wafer 44 is placed in a way that the first surface 45 faces the pedestal 40, and a fluid 48 is sprayed out from the spray orifice onto the first surface 45 of the wafer 44 simultaneously to form a fluid layer in the load cup, such that the wafer 44 and the pedestal 40 are separated by the fluid layer. The surface tension of the fluid layer may assist the wafer 44 to leave the polishing head 52 and float in the load cup to avoid a contact of the first surface 45 with the pedestal 40. As aforesaid, the fluid contains a charge-forming chemical substance dissolved therein for preventing from electrostatic discharge. Thereafter, the wafer is taken by a transfer robot and placed into a loadlock chamber for transferring to other system.

The chemical mechanical polisher mentioned above may be for example the Mirra type chemical mechanical polisher commercially available from Applied Materials Inc., USA, and especially a chemical mechanical polisher for the planarization of a dielectric layer, such as an oxide layer, on the wafer. As compared with conventional techniques, in the present invention, the fluid used at the HCLU station is added a charge-forming chemical substance (for example, when water is used as the fluid, it becomes a carbonated water as $CO_2$ is added), for effectively neutralizing the charges. Thus, a local discharge damage of the wafer due to the waterfall effect occurred to the water spray used for assisting the wafer transfer can be prevented, and the yield will be improved.

Although the illustrative embodiments disclose the method of the present invention to transfer a wafer in a chemical mechanical polisher for preventing the wafer from local discharge damage, the present invention is of equal value where wafer transfer in such way is required and should not be construed as being limited to the chemical mechanical polishing system. That is, in case the mechanism of the wafer transfer is with the assistance of a fluid to load/unload the wafer, it may be encompassed within the scope of the present invention. Therefore, the method according to the present invention comprises steps as follows. Also referring to FIG. 5, first, a pedestal 40 is provided and at least one spray orifice 42 extends through the pedestal 40. A wafer 44 is placed above the pedestal 40 using a first robot (not shown). The wafer 44 has a first surface 45 and a second surface 46, and is placed in such orientation that the first surface 45 faces the pedestal 40. A fluid 48 is sprayed from the spray orifice 42 onto the first surface 45 of the wafer 44 simultaneously to avoid a contact of the first surface 45 with the pedestal 40. A charge-forming chemical substance 50 is dissolved in the fluid 48. Thereafter, the wafer 44 is removed using a second robot. The second robot may be for example a polishing head 52.

All combinations and sub-combinations of the above-described features also belong to the present invention. Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of transferring a wafer, comprising:

providing a pedestal having at least one spray orifice extending therethrough;

disposing a wafer above the pedestal using a first robot, the wafer having a first surface and a second surface, the first surface facing the pedestal, and spraying a fluid from the spray orifice onto the first surface simultaneously to avoid a contact of the first surface with the pedestal, wherein the fluid contains a charge-forming chemical substance dissolved therein and the wafer is not polished on the pedestal using the fluid as a polishing slurry; and removing the wafer from the fluid using a second robot.

2. The method as claimed in claim 1, wherein the fluid comprises water.

3. The method as claimed in claim 1, wherein the charge-forming chemical substance comprises $O_2$, $O_3$, $N_2$, $CO_2$, $NH_3$, or air.

4. The method as claimed in claim 1, wherein the charge-forming chemical substance comprises an electrolyte.

5. The method as claimed in claim 1, wherein the fluid containing a charge-forming chemical substance dissolved therein has a pH of 5 to 9.

6. The method as claimed in claim 1, wherein the pedestal is disposed in a load cup.

* * * * *